US007485053B2

(12) United States Patent
Nally

(10) Patent No.: US 7,485,053 B2
(45) Date of Patent: Feb. 3, 2009

(54) NET POST MOUNTED ELECTRONIC SCORER FOR TABLE TENNIS

(75) Inventor: Michael Nally, Ridgewood, NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 143 days.

(21) Appl. No.: 11/608,680

(22) Filed: Dec. 8, 2006

(65) Prior Publication Data

US 2008/0139344 A1 Jun. 12, 2008

(51) Int. Cl.
*A63B 67/04* (2006.01)
*A63B 71/04* (2006.01)
*A63B 71/06* (2006.01)

(52) U.S. Cl. ..... 473/496; 473/494

(58) Field of Classification Search ..... 473/491, 473/494, 496; 273/DIG. 26; 340/323 R
See application file for complete search history.

(56) References Cited

U.S. PATENT DOCUMENTS

| | | | | |
|---|---|---|---|---|
| 2,296,508 | A | 9/1942 | Eckert | |
| 2,455,422 | A | 12/1948 | Kucks | |
| 3,863,921 | A * | 2/1975 | Price | 473/491 |
| 4,119,838 | A | 10/1978 | Genuit | |
| 4,211,406 | A | 7/1980 | Roesler et al. | |
| 4,237,372 | A | 12/1980 | Zevgolis et al. | |
| 4,491,954 | A | 1/1985 | Genuit | |
| 5,566,936 | A | 10/1996 | Newgarden et al. | |
| 5,574,422 | A | 11/1996 | Martin | |
| 5,733,210 | A | 3/1998 | Yiu | |
| 5,769,744 | A * | 6/1998 | Merrill et al. | 473/493 |
| 6,012,995 | A | 1/2000 | Martin | |
| 6,270,431 | B1 | 8/2001 | Martin | |
| 2003/0008733 | A1 | 1/2003 | Allshouse et al. | |
| 2008/0139344 | A1 * | 6/2008 | Nally | 473/496 |

FOREIGN PATENT DOCUMENTS

| | | |
|---|---|---|
| DE | 4204928 | 8/1993 |

* cited by examiner

*Primary Examiner*—Raleigh W. Chiu
(74) *Attorney, Agent, or Firm*—Fellers, Snider, Blankenship, Bailey & Tippens

(57) ABSTRACT

A net post and electronic scoring assembly for use with a table tennis table is discussed. The net posts are provided with horizontal sections for extending over a gap in the center of a typical table tennis table. The offset net posts permit a table tennis net to be centered over the gap of the table tennis table. The net posts are configured such that each post is affixed to the same side of the table, thereby permitting more accurate net placement. Post mounted electronic display units may be located on either of the net posts. The post mounted electronic display units communicate with a score input module. In use, a player may manipulate buttons on the score input module to change the score displayed by one or both of the electronic display units.

15 Claims, 4 Drawing Sheets

NET POST MOUNTED ELECTRONIC SCORER FOR TABLE TENNIS

FIELD OF THE INVENTION

The invention relates generally to a table tennis net post and post mounted scoring displays for table tennis. More particularly, the invention relates to offset net posts that allow for centering of the table tennis net in the center of the playing surface and electronic post mounted scoring displays.

BACKGROUND OF THE INVENTION

The game of table tennis utilizes small solid racquets or paddles. During play, a first player serves a ball over a net and a second player on the opposing team hits the ball back until one player fails to return the ball. The racquet, or paddle, is made of wood and the racquet head is typically covered with a layer of rubber. A regulation table tennis table is 274 cm long, 152 cm wide and 76 cm high. The tables generally have a dark green or blue colored wooden top.

A typical table tennis table has a first and a second section of a table tennis playing surface defining a gap there between. Each section may be hingedly affixed to a base structure so that the table may be folded up for storage. When positioned in a playing configuration, net posts are typically affixed to each side of the table for receiving ends of a table tennis net.

A difficulty associated with table tennis net posts is that conventional net posts have a clamping surface that spans the gap between the first and second sections of the playing surface. Oftentimes, the playing surfaces are not in perfect alignment, which then affects net placement and orientation when the spanning clamps are applied.

A second difficulty experienced by recreational players of table tennis is that of keeping track of the score. Many players have difficulty focusing on game play while simultaneously remembering the score.

Therefore, it is desirable to provide an improved net post that allows for easily locating the net in a vertical orientation. It is further desirable to provide a net post that permits easy centering of the net over the gap between the playing surfaces.

It is additionally desirable to provide a score display device that may be actuated by a player to tally the score of a match and to display the score to each player. It is also desirable to provide score display devices that may be positioned over the table tennis net posts so that the devices are located in a convenient location that does not affect game play.

SUMMARY OF THE INVENTION

A first post and a second post are clamped to one section of a table tennis table, e.g., the first section. A horizontal section of the first post and a horizontal section of the second post extend horizontally from the clamping section of each post. An upper vertical section or net receiving portion extends upwardly from the horizontal section of each post. The upper vertical section of each post is provided for receiving an end of a table tennis net. The horizontal section of each post extends over the gap in the playing surface so that, when installed, the net is substantially centered over the gap.

Electronic display units are provided that may be positioned over one or both of the net posts. The electronic display units have a housing that defines a vertical gap that communicates with a vertical planar space for accommodating a net post and the attached net.

The display units preferably have a lower surface that defines a horizontal recessed area. The recessed area extends towards the first baseline for at least a distance equal to a length of the horizontal section of the first and second post. Additionally, the recessed area extends towards the second baseline for at least a distance equal to a length of the horizontal sections for allowing the recessed area to receive the horizontal section of the first or second post. Therefore, the post mounted display units may be located on either of the above described posts.

Preferably, the housing defines a first window on a first side and a second window on a second side of each of the display units for displaying LED displays to each of the players. Alternatively, the first display unit may have a window for displaying an LED display to a first player and the second display unit may have a window for displaying a second LED display to a second player. A single LED display may also be provided for just one side of the table.

A score input module is preferably provided beneath at least one end of the table tennis table. An electronic communication link is provided between the score input module and the first post mounted display unit. The score input module preferably has a first positive increment switch for inputting a positive score change for a first player and a second positive increment switch for inputting a positive score change for a second player. A first negative increment switch is provided for inputting a negative score change for the first player and a second negative increment switch is provided for inputting a negative score change for the second player.

DETAILED DESCRIPTION OF THE PREFERRED EMBODIMENTS

Figure 6:
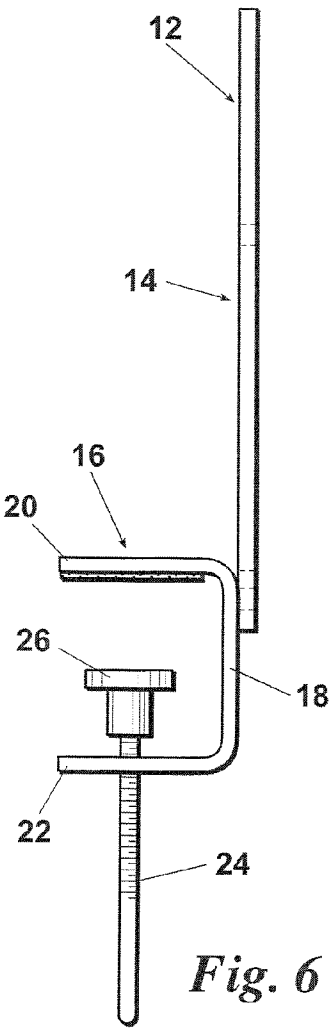
FIG. 6 is a side elevation view of the first net post of FIG. 5.
Figure 5:
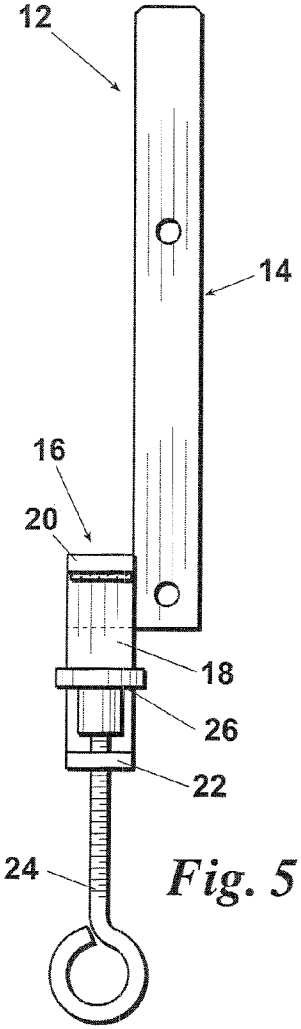
FIG. 5 is an elevation view of first net post.
Figure 7:
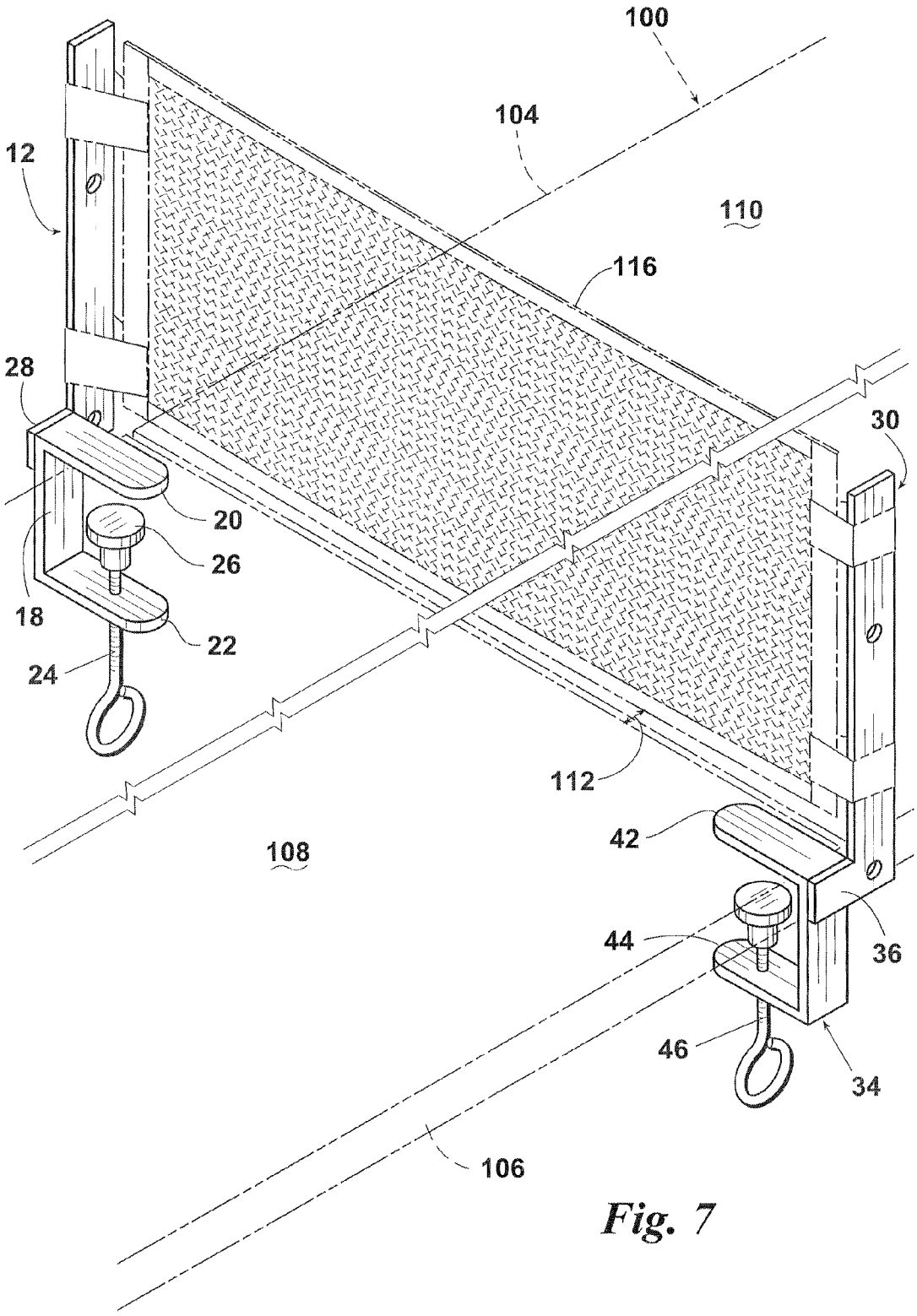
FIG. 7 is a perspective view of a table tennis net installed on the first net post and the second net post of FIGS. 4-6.

Referring first to FIGS. 1-7, shown is a post mounted electronic table tennis scorer system 10. The scorer system 10 includes first post 12 (FIGS. 5-7). First post 12 includes first post section 14 and first clamping section 16. First clamping section 16 has vertical member 18 with an upper end connected to upper member 20 and a lower end connected to lower member 22. Lower member 22 preferably defines a threaded orifice for receiving threaded eyebolt 24. Threaded eyebolt 24 has pad 26 affixed to an upper end thereof. First post 12 additionally includes first horizontal segment 28 (FIG. 7) that extends over seam 112 (FIG. 7) of table tennis table 100 when first clamping section 16 is engaged with first side 104 of table tennis 100.

Figure 4:
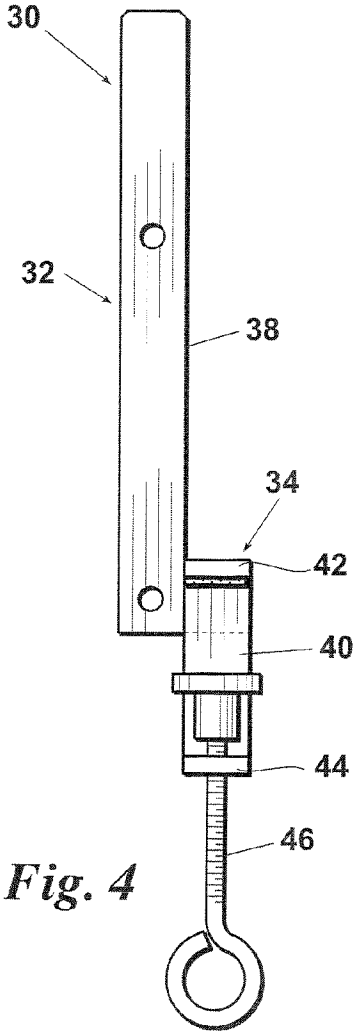
FIG. 4 is an elevation view of a second net post.

Post mounted electronic tennis scorer system 10 further includes second post 30 (FIGS. 4 and 7). Second post 30 has second post section 32 and second clamping section 34. Second post section 32 has second horizontal segment 36 and second vertical section 38. Second clamping section 34 has vertical member 40 connected at an upper end to upper member 42 and connected at a lower end to lower member 44. Lower member 44 defines a threaded orifice for receiving a threaded eyebolt 46 having pad 48 affixed to an upper end. Second horizontal segment 28 extends towards first baseline 102 of table tennis table 100 when second clamping section 34 is engaged with second side 106 of table tennis table 100 for facilitating clamping of both first post 12 and second post 30 on one of first section 108 and second section 110 of table tennis table 100, wherein first horizontal segment 28 and second horizontal segment 36 extend over gap 112 defined by first playing surface 108 and second playing surface 110 of table tennis table 100.

A first post mounted display unit 50 (FIGS. 1 and 2) has housing 52 defining a first side 54 that faces first baseline 102 of table tennis table 100 when first post mounted display unit 50 is installed. Housing 52 further defines a second side 56 that faces second baseline 114 of table tennis table 100 when first post mounted display unit 50 is installed.

Housing 52 further defines vertical interior channel 58 for receiving one of first post 12 and second post 30. Housing 52 further defines a vertical space 60 (FIG. 1) for accommodating net 116 when display unit 50 is affixed to first post 12 and second post 30.

Housing 52 further defines lower surface 62. Lower surface 62 defines horizontal recessed area 64 that is in communication with the lower end of vertical interior channel 58. Recessed area 64 extends away from channel 58 towards first baseline 102 for at least a distance "X" defined as a distance equal to a length of first horizontal segment 28 and equal to a length of second horizontal segment 36. Recessed area 64 also extends towards second baseline 114 for at least a distance "X" as defined above. Since horizontal recessed area 64 extends away from channel 58 in both directions, the first post mounted display unit 50 may be located on either of first post 12 or second post 30.

Housing 52 further defines first window 66 on first side 54 and defines a second window (not shown) on second side 56. First LED display 68 is positioned to be visible through first window 66 and a second LED display (not shown) is positioned to be visible through the second window.

A second post mounted display unit 70 (FIGS. 1 and 2) has housing 72 defining a first side 74 that faces first baseline 102 (FIG. 1) of table tennis table 100 when second post mounted display unit 70 is installed as shown. Housing 72 further defines a second side (not shown) that faces second baseline 114 (FIG. 1) of table tennis table 100 when second post mounted display unit 70 is installed as shown. As discussed above, post mounted display units 50 and 70 may be located on either of first post 12 or second post 30.

Housing 72 further defines vertical interior channel 76 for receiving one of first post 12 and second post 30. Housing 72 further defines a vertical space 84 (FIG. 1) for accommodating net 116 (FIG. 1) when second display unit 70 is affixed to first post 12 or second post 30.

Figure 2:
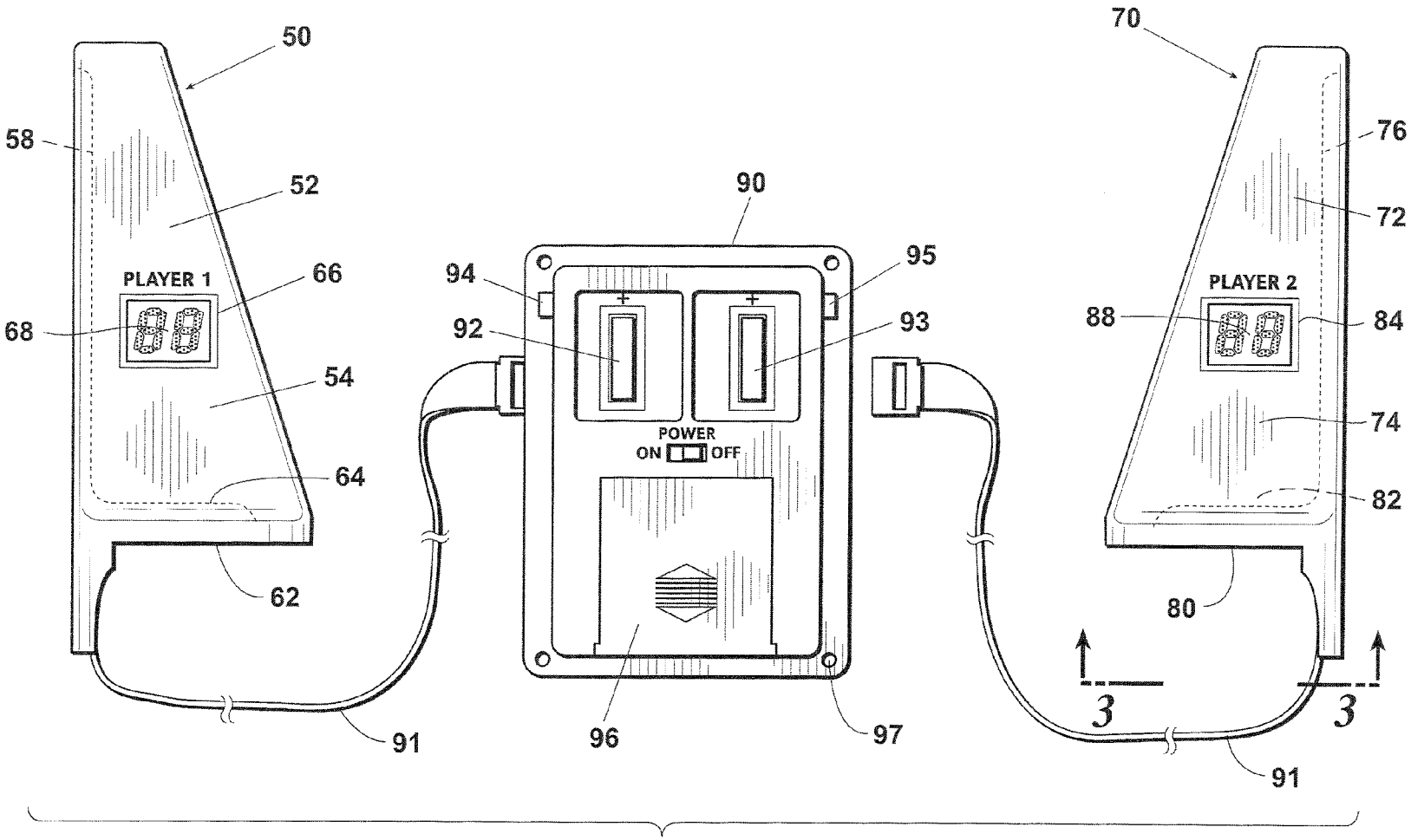
FIG. 2 is an elevation view of the post mounted display unit assembly including a first post mounted display unit, a second post mounted display unit, and a score input module.
Figure 3:
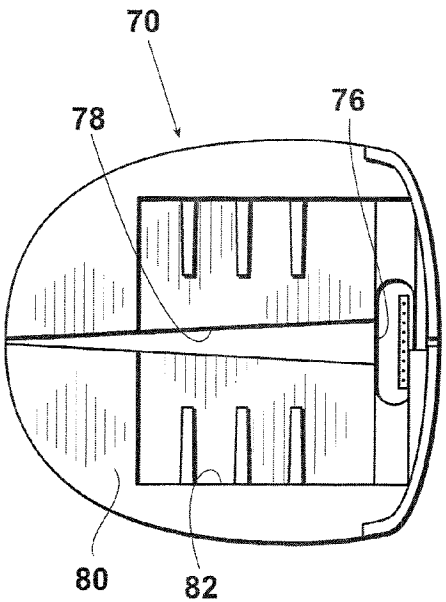
FIG. 3 is bottom view taken along line 3-3 of the second post mounted display unit of FIG. 2.

Housing 72 further defines lower surface 80 (FIGS. 2 and 3). Lower surface 80 defines horizontal recessed area 82 that is in communication with the lower end of vertical interior channel 76. Recessed area 82 extends away from channel 76 towards first baseline 102 for at least a distance "X," defined as a distance equal to a length of first horizontal segment 28 and equal to a length of second horizontal segment 36. Recessed area 82 also extends towards second baseline 114 for at least a distance "X" as defined above. Since horizontal recessed area 82 extends away from channel 58 in both directions, the first post mounted display unit 70 may be located on either of first post 12 or second post 30.

Housing 72 further defines first window 84 on first side 74 and defines a second window (not shown) on second side 86. First LED display 88 is positioned to be visible through first window 84 and a second LED display (not shown) is positioned to be visible through the second window.

Figure 1:
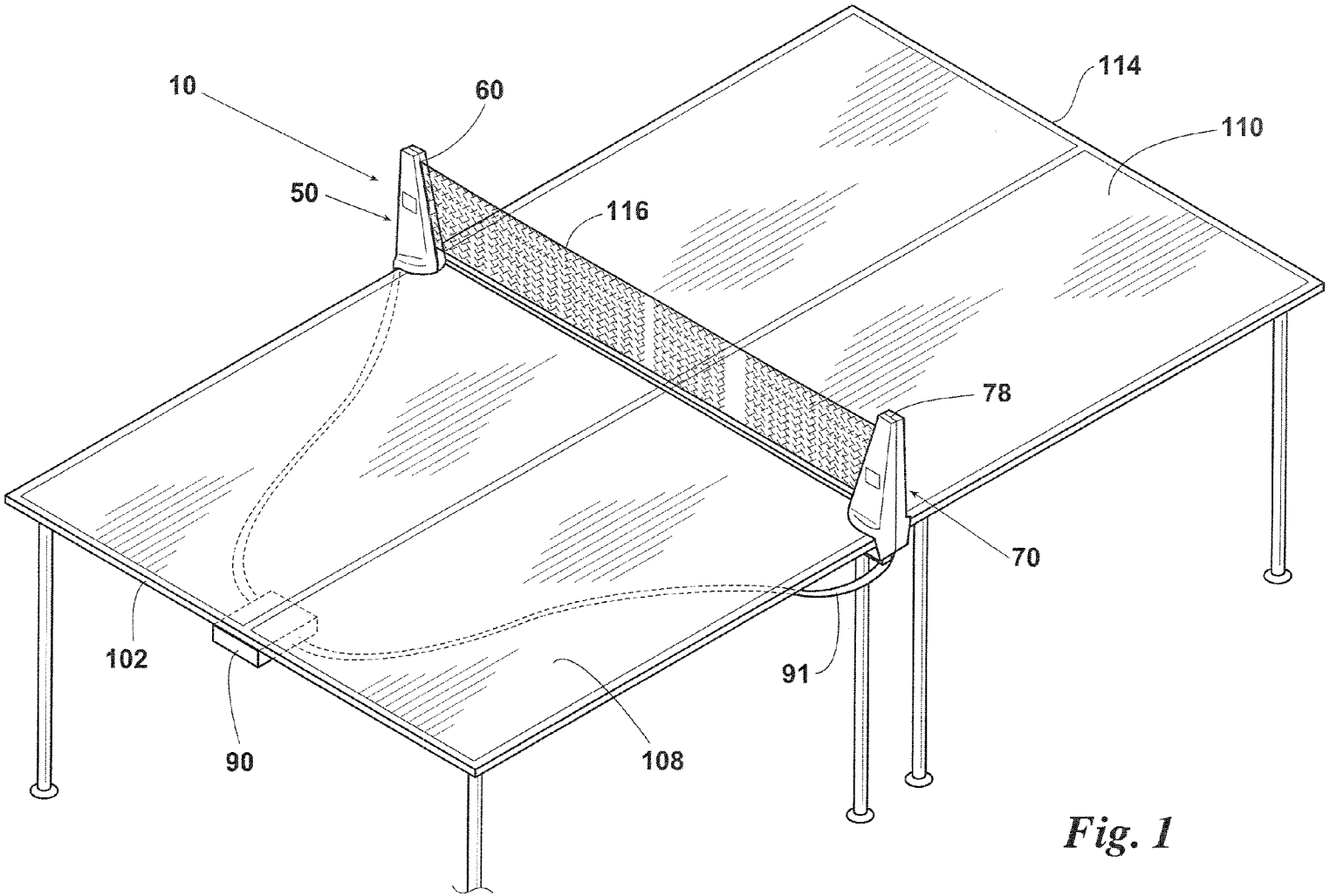
FIG. 1 is a perspective view of a table tennis table in a playing configuration with post mounted display units installed.

Post mounted electronic table tennis scorer system 10 additionally includes score input module 90 (FIGS. 1 and 2). Electronic communication link 91 connects scorer input module 90 with first post mounted display unit 50. Electronic communications link 91 is preferably a wire or cable, but may also be a wireless signal or other suitable signal means as desired. Scorer input module 90 is preferably provided with first positive increment switch 92 (FIG. 2) for inputting a positive score change for a first player. Scorer input module 90 is additionally provided with second positive increment switch 93 for inputting a positive score change for a second player. A first negative increment switch 94 is also provided for inputting a negative score change for the first player and second negative increment switch 95 is provided for inputting a negative score change for a second player.

Scorer input module 90 additionally defines housing 96 for receiving a battery. The scorer input module 90 is preferably provided with a plurality of orifices 97 so that score input module 90 may be secured to an underside of first section 108 or second section 110 of table tennis table 100.

As will be apparent to those skilled in the art, a number of modifications could be made to the preferred embodiments which would not depart from the spirit or the scope of the present invention. Thus, the present invention is well adapted to carry out the objects and attain the ends and advantages mentioned above as well as those inherent therein. While the presently preferred embodiments have been described for purposes of this disclosure, numerous changes and modifications will be apparent to those skilled in the art. Such changes and modifications are encompassed within the spirit of this invention.

What is claimed is:

1. A table tennis table comprising:

a first section of a table tennis playing surface;

a second section of said table tennis playing surface;

a gap defined by an inside end of said first section and an inside end of said second section;

a first post having a clamping section affixed to said first section of said table tennis playing surface, said first post having net receiving portion and a horizontal section between said clamping section and said net receiving portion;

a second post having a clamping section affixed to said first section of said table tennis playing surface, said second post having a net receiving portion and a horizontal section between clamping section and said net receiving portion;

wherein said horizontal section of said first post and said horizontal section of said second post extend over said gap defined by said first section and said second section of said table tennis playing surface so that said net receiving portion of said first post and said net receiving portion of second post are substantially centered over said gap;

a first post mounted display unit having a housing defining a vertical interior channel for receiving one of said net receiving portion of said first post and said net receiving portion of said second post, said first post mounted display unit defining a vertical planar space for accommodating a net;

said housing further defining a first side facing a first baseline of said table tennis playing surface when installed and defining a second side facing a second baseline of said table tennis playing surface when installed.

2. The table tennis table according to claim 1 wherein:

said first post mounted display unit further defines a lower surface defining a horizontal recessed area in communication with a lower end of said vertical interior channel, said recessed area extending towards said first baseline for at least a distance equal to a length of said horizontal section of said first post and said horizontal section of said second post, said recessed area extending towards a said second baseline for at least a distance equal to a length of said horizontal sections for allowing said recessed area to accommodate said horizontal section of said first post or said second horizontal section of said second post so that said first post mounted display unit may be located on either of said first post and said second post.

3. The table tennis table according to claim 2 further comprising:

a second post mounted display unit having a housing defining a vertical interior channel for receiving the other of said net receiving portion of said first post and said net receiving portion of said second post, said second post mounted display unit defining a vertical planar space for accommodating said net;

said housing defining a first side facing said first baseline of said table tennis playing surface when installed and defining said second side facing said second baseline of said table tennis playing surface when installed.

4. The table tennis table according to claim 3 wherein:

said second post mounted display unit further defines a lower surface defining a horizontal recessed area in communication with a lower end of said vertical interior channel, said recessed area extending towards said first baseline for at least a distance equal to a length of said horizontal section of said first post and said horizontal section of said second post, said recessed area extending towards a said second baseline for at least a distance equal to a length of said horizontal section of said first post and said horizontal section of said second post, for allowing said recessed area to accommodate said horizontal section of said first post or said horizontal section of said second post so that said second post mounted display unit may be located on either of said first post and said second post.

5. The table tennis table according to claim 1 wherein:

said housing defines a first window on said first side and a second window on said second side; and further comprising a first score display visible through said first window;

a second score display visible through said second window.

6. The table tennis table according to claim 1 further comprising:

a score input module;

an electronic communication link between said score input module and said first post mounted display unit.

7. The table tennis table according to claim 6 wherein:

said score input module has a first positive increment switch for inputting a positive score change for a first player and a second positive increment switch for inputting a positive score change for a second player;

said score input module having a first negative increment switch for inputting a negative score change for said first player and a second negative increment switch for inputting a negative score change for said second player.

8. The table tennis table according to claim 6 wherein:

wherein said score input module is configured for installation on an underside of said table tennis playing surface.

9. An electronic table tennis scorer system comprising:

a first post mounted display unit having a housing defining a vertical interior channel for receiving a table tennis net post, said housing defining a vertical planar space for accommodating a net;

said housing defining a first side facing a first baseline of said table tennis table when installed and defining a second side facing a second baseline of a table tennis playing surface when installed.

10. The electronic table tennis scorer system according to claim 9 comprising:

said first post mounted display unit further defines a lower surface defining a horizontal recessed area in communication with a lower end of said vertical interior channel, said recessed area extending towards said first baseline for at least a distance equal to a length of a horizontal segment of an offset table tennis net post, said recessed area extending towards a said second baseline for at least a distance equal to a length of said horizontal segment of an offset table tennis net post, for allowing said recessed area to accommodate said horizontal segment so that said first post mounted display unit may be located on either of a first post and a second post.

11. The electronic table tennis scorer system according to claim 10 comprising:

said second post mounted display unit further defines a lower surface defining a horizontal recessed area in communication with a lower end of a vertical interior channel, said recessed area extending towards said first baseline for receiving a horizontal segment of an offset table tennis net post, said recessed area extending towards said second baseline for at least a distance equal to a length an offset table tennis net post, for allowing said recessed area to accommodate said horizontal segment so that said second post mounted display unit may be located on either of said first post and said second post.

12. The electronic table tennis scorer system according to claim 9 wherein:

said housing defines a first window on said first side and a second window on said second side; and further comprising a first score display visible through said first window;

a second score display visible through said second window.

13. The electronic table tennis scorer system according to claim 9 comprising:

a score input module; and an electronic communication link between said score input module and said first post mounted display unit.

14. The electronic table tennis scorer system according to claim 13 wherein:

said score input module has a first positive increment switch for inputting a positive score change for a first player and a second positive increment switch for inputting a positive score change for a second player;

said score input module having a first negative increment switch for inputting a negative score change for a first player and a second negative increment switch for inputting a negative score change for a second player.

15. The electronic table tennis scorer system according to claim 13 comprising:

wherein said score input module is configured for installation on an underside of said table tennis table.

* * * * *